US009342047B2

(12) United States Patent
Fujiwara et al.

(10) Patent No.: US 9,342,047 B2
(45) Date of Patent: May 17, 2016

(54) MOVEMENT LIMITING APPARATUS FOR IMAGE FORMING APPARATUS PROCESS CARTRIDGE

(75) Inventors: Akihiro Fujiwara, Mishima (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/606,412

(22) Filed: Sep. 7, 2012

(65) Prior Publication Data

US 2013/0064568 A1 Mar. 14, 2013

(30) Foreign Application Priority Data

Sep. 14, 2011 (JP) ..... 2011-201208

(51) Int. Cl.
*G03G 15/06* (2006.01)
*G03G 21/18* (2006.01)

(52) U.S. Cl.
CPC ..... *G03G 21/1821* (2013.01)

(58) Field of Classification Search
CPC ..... G03G 21/1821
USPC ..... 399/90, 92, 93, 120, 111
See application file for complete search history.

(56) References Cited

U.S. PATENT DOCUMENTS 6,272,300 B1 * 8/2001 Fujiwara ..... G03G 21/181 399/111
6,898,391 B2 * 5/2005 Numagami ..... G03G 21/185 399/111
6,912,365 B2 * 6/2005 Ueno ..... G03G 21/185 399/111
6,934,485 B2 8/2005 Miyabe et al.
7,373,096 B1 * 5/2008 Miller ..... 399/114
8,155,553 B2 4/2012 Takarada
8,155,554 B2 * 4/2012 Miyabe ..... G03G 21/1867 399/111
2009/0297202 A1 * 12/2009 Takarada ..... 399/90
2011/0076048 A1 * 3/2011 Uto et al. ..... 399/90
2011/0280620 A1 * 11/2011 Chadani ..... G03G 21/1871 399/111
2012/0093538 A1 * 4/2012 Koishi ..... G03G 21/1867 399/90

FOREIGN PATENT DOCUMENTS

JP 09-062167 A 3/1997
JP 09062167 A2 * 3/1997
JP 2005-326618 A 11/2005

OTHER PUBLICATIONS

Office Action in Japanese Patent Application No. 2011-201208, dated Jul. 28, 2015.

* cited by examiner

*Primary Examiner* — Benjamin Schmitt
*Assistant Examiner* — Matthew Miller
(74) *Attorney, Agent, or Firm* — Fitzpatrick, Cella, Harper & Scinto

(57) ABSTRACT

A cartridge detachably mountable to a main assembly of an image forming apparatus having a main assembly electric contact includes: a contact member for receiving pressure by the main assembly electric contact, wherein the contact member has a first surface as a contact portion for receiving the pressure by the main assembly electric contact and has a second surface bent from the first surface toward a side opposite from a side where the main assembly electric contact is provided; a holding member for holding the contact member; a portion to be limited provided at an end of the second surface; and a limiting portion, provided on the holding member, for limiting movement of the portion to be limited.

6 Claims, 7 Drawing Sheets

MOVEMENT LIMITING APPARATUS FOR IMAGE FORMING APPARATUS PROCESS CARTRIDGE

FIELD OF THE INVENTION AND RELATED ART

The present invention relates to a process cartridge used in an electrophotographic image forming apparatus.

Here, the electrophotographic image forming apparatus forms an image on a recording material (medium) by using an electrophotographic image forming process. Examples of the image forming apparatus may include a printer (LED printer, laser beam printer or the like), a copying machine, a facsimile machine, a word processor and a multi-function machine (multi-function printer or the like) of the these machines.

In the image forming apparatus such as the printer using the electrophotographic process, a drum-like electrophotographic photosensitive member (hereinafter referred to as a photosensitive drum) which is an image bearing member is electrically charged uniformly and is subjected to selective exposure to light to form a latent image. Then, the latent image is visualized (developed) with a toner as a developer, and a resultant toner image is transferred onto a recording material. Then, the transferred roller image is subjected to application of heat and pressure to be fixed on the recording material, so that image recording (image formation) is effected.

Such an apparatus is subjected to toner supply or maintenance of various process means. For this reason, as a means for facilitating a toner supplying operation or the maintenance, a process cartridge prepared by integrally assembling the photosensitive drum, a charging means, a developing means, a cleaning means and the like in a frame has been put into practical use.

According to this process cartridge type, the maintenance of the apparatus can be performed by a user himself (herself), so that operativity can be remarkably improved. Therefore, the process cartridge type has been widely used in the image forming apparatus.

Further, in recent years, a color image forming apparatus for forming a color image by using developers of a plurality of colors has been popularized. As the color image forming apparatus, an in-line type image forming apparatus in which photosensitive drums corresponding to image forming operations using toners of the plurality of colors are disposed in line along a surface movement direction of a toner image receiving member onto which the toner image is to be transferred has been known.

In the color image forming apparatus of the in-line type, there is an apparatus in which the plurality of photosensitive drums are disposed in line with respect to a direction (e.g., a horizontal direction) crossing the vertical direction (the direction of the gravitation). The in-line type is a preferably image forming type in terms of easy response to demands such as speed-up of an image forming speed and development to a multi-function printer.

In the process cartridge, in general, a developing device frame for supporting the developing means is provided with a developing roller, as the developing means, including a metal shaft and an electroconductive rubber member, and a developing blade as a developer regulating member. Further, on a side surface of the developing device frame, a gear train for rotationally driving the developing roller and an electroconductive member for applying a bias (voltage) to the developing roller are provided. In the process cartridge including such an electroconductive member, in order to stably effect application of a developing bias voltage to the rotationally driven developing roller, a constitution in which the electroconductive member is contacted to an end surface of the metal shaft of the developing roller has been proposed (U.S. Pat. No. 8,155,553).

Further, in general, in order to supply the bias from an image forming apparatus main assembly to the process cartridge, a contact member is provided to the process cartridge and is contacted to a main assembly (-side) electric contact provided to the apparatus, so that the bias is applied. In this case, in order to supply a stable bias, the contact member is required to receive a predetermined contact (point) pressure from the main assembly electric contact. For that reason, there was a conventional constitution in which a limiting member for limiting movement of the contact member is provided in a back side of the contact member (U.S. Pat. No. 6,934,485).

However, as described above, in the constitution in which the contact member receives the contact pressure from the main assembly electric contact and thus the bias is applied, there is the case where it is difficult to dispose the limiting member for limiting movement of the contact member in the back side of the contact member.

SUMMARY OF THE INVENTION

A principal object of the present invention is to provide a process cartridge capable of limiting movement of a contact member even in the case where it is difficult to dispose a limiting member for limiting movement of the contact member in a back side of the contact member.

This object is accomplished by a process cartridge according to the present invention.

According to an aspect of the present invention, there is provided a cartridge detachably mountable to a main assembly of an image forming apparatus having a main assembly electric contact, the cartridge comprising: a contact member for receiving pressure by the main assembly electric contact, wherein the contact member has a first surface as a contact portion for receiving the pressure by the main assembly electric contact and has a second surface bent from the first surface toward a side opposite from a side where the main assembly electric contact is provided; a holding member for holding the contact member; a portion to be prevented provided at an end of the second surface; and a limiting portion, provided on the holding member, for limiting movement of the portion to be limited.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The process cartridge according to the present invention will be described specifically with reference to the drawings.

Embodiment 1

[General Structure of Image Forming Apparatus]

Figure 1:
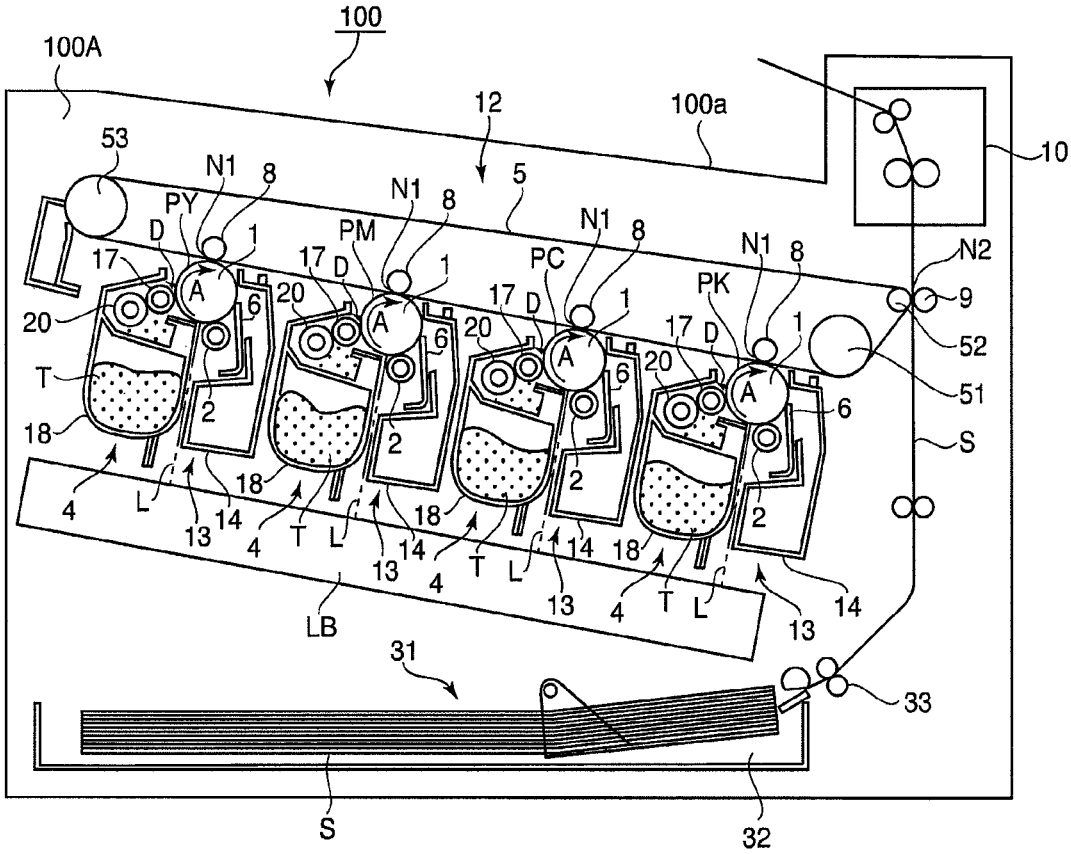
FIG. 1 is a schematic sectional view of an example of a structure of an image forming apparatus to which a process cartridge according to the present invention is applied.

FIG. 1 is a schematic sectional view of an example of a structure of a color electrophotographic image forming apparatus to which a process cartridge according to the present invention is applied. In this embodiment, a color electrophotographic image forming apparatus 100 is a four color-based full-color laser printer using an electrophotographic process and effects color image formation on a recording material (recording medium) S. The image forming apparatus 100 in this embodiment is of a process cartridge type in which a process cartridge P is detachably mounted in an image forming apparatus main assembly 100A and then a color image is formed on the recording material S.

In the following description, the image forming apparatus main assembly 100A refers to an apparatus constituent portion excluding the process cartridge P.

In the apparatus main assembly 100A, a plurality of process cartridges, i.e., in this embodiment, first to fourth portions P (PY, PM, PC, PK) are juxtaposed in the horizontal direction. Thus, by arranging the plurality of process cartridges P in the horizontal direction, a height of the image forming apparatus can be suppressed. The respective cartridges P have the same electrophotographic process mechanism but are different in color of an associated developer (toner) T and in an amount of the toner T. To each cartridge P, a rotational driving force is transmitted from the apparatus main assembly 100A. Further, to each cartridge P, biases (charging bias voltage, developing bias voltage, and the like) are supplied (not shown) from the apparatus main assembly 100A.

Figure 2:
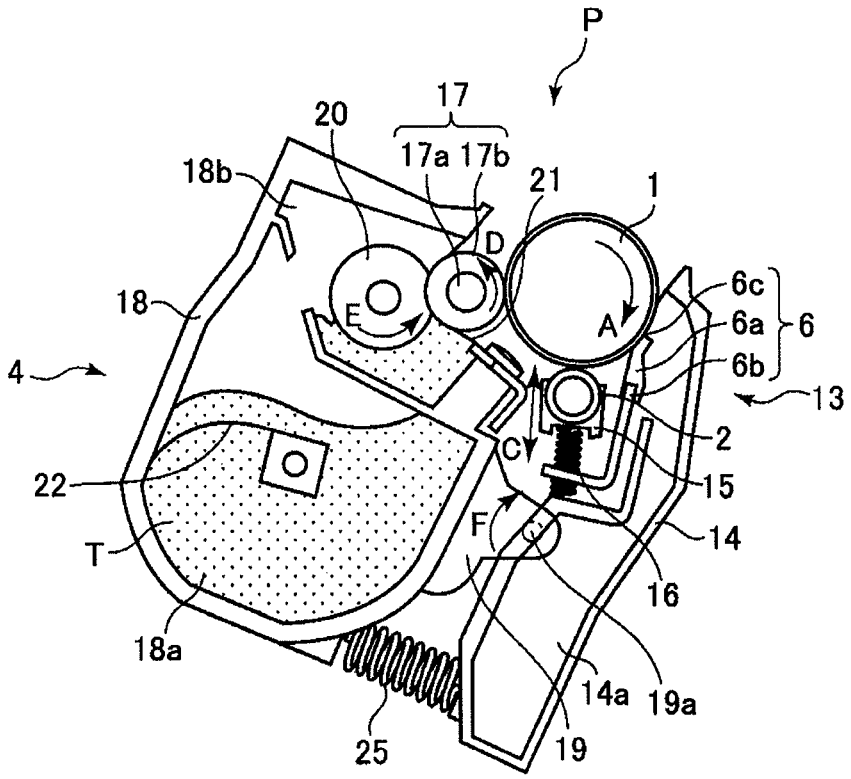
FIG. 2 is a principal sectional view of the process cartridge in Embodiment 1.

As shown in FIG. 2, each cartridge P in this embodiment includes a drum-like electrophotographic photosensitive member, i.e., a photosensitive drum 1 as an image bearing member. Further, each cartridge P includes the charging roller 2 as an electrophotographic process means acting on the photosensitive drum 1 and includes an electrophotographic cleaning unit 13 provided with a cleaning blade 6. Further, each cartridge P includes a developing unit 4 provided with a developing means for developing an electrostatic latent image formed on the photosensitive drum 1. The cleaning unit 13 and the developing unit 4 are rotatably (movably) connected with each other. A specific structure of each cartridge P will be described later.

In FIG. 1, the first process cartridge PY accommodates the toner T of yellow (Y) in a developing device frame 18 and forms the toner image of yellow (Y) on the surface of the photosensitive drum 1. Similarly, the second process cartridge PM accommodates the toner T of magenta (M) in the developing device frame 18, the third process cartridge PC accommodates the toner T of cyan (C) in the developing device frame 18, and the fourth process cartridge PK accommodates the toner T of black (K) in the developing device frame 18, and form color toner images on the surfaces of associated photosensitive drums 1, respectively.

Below each of the cartridges P (PY, PM, PC, PK), a laser scanner unit LB as an exposure means is disposed. The laser scanner unit LB outputs laser light L correspondingly to image information. The surface of the photosensitive drum 1 is subjected to scanning exposure to the laser light L.

On each of cartridges P (PY, PM, PC, PK), an intermediary transfer belt unit 12 as a primary transfer member is disposed. This intermediary transfer belt unit 12 includes a flexible endless transfer belt 5 and rollers, for stretching and rotating the transfer belt 5, consisting of a driving roller 51, a secondary transfer opposite roller 52 and a follower roller 53. The photosensitive drum 1 of each cartridge P is contacted to the transfer belt 5 at its upper surface. A contact portion N1 between the photosensitive drum 1 and the transfer belt 5 is a primary transfer portion. Inside the transfer belt 5, primary transfer rollers 8 are disposed opposed to the associated photosensitive drums 1. At a position opposing the secondary transfer opposite roller 52, a secondary transfer roller 9 as a secondary transfer means is disposed. A contact portion N2 between the transfer belt 5 and the secondary transfer roller 9 is a secondary transfer portion.

Below the lower scanner unit LB, a sheet feeding unit 31 is disposed. The sheet feeding unit 31 includes a tray 32 in which sheets of the recording material S are stacked and accommodated and includes a sheet feeding roller group 33, and the like.

In an upper right side of the apparatus main assembly 100A, a fixing unit 10 is disposed. An upper surface 100*a* of the apparatus main assembly 100A constitutes a sheet discharge tray.

[Image Forming Operation]

An operation for forming a full-color image is as follows.

The photosensitive drums 1 of the first to fourth cartridges P (PY, PM, PC, PK) are rotationally driven in an arrow A direction at a predetermined speed. The transfer belt 5 is rotationally driven in an arrow B direction (codirectionally with the photosensitive drums at their contact portions) at a speed corresponding to the speed of the photosensitive drums 1. The laser scanner unit LB is also driven.

In synchronism with the drive of the laser scanner unit LB, the surface of the photosensitive drum 1 of each cartridge P is uniformly charged to a predetermined polarity and a predetermined potential by the charging roller 2. The laser scanner unit LB scans and exposes the surface of each photosensitive drum 1 with the laser light L depending on an image signal for an associated color. As a result, an electrostatic latent image depending on the image signal for the associated color is formed on the surface of each photosensitive drum 2. The thus formed electrostatic latent image is developed by the developing roller 17 rotationally driven in an arrow D direction at a predetermined speed.

By the above-described electrophotographic image forming process operation, on the photosensitive drum 1 of the first cartridge PY, a yellow (Y) toner image corresponding to a yellow component of a full-color image is formed. Then, the Y toner image is primary-transferred onto the transfer belt 5.

Similarly, the toner images of the second cartridge PM, the third cartridge PC and the fourth cartridge PK are superposed on the transfer belt 5, so that unfixed toner images for a four color-based full-color image are formed. In each cartridge P, a transfer residual toner remaining on the surface of the photosensitive drum 1 after the primary transfer is removed by the cleaning blade 6.

On the other hand, with predetermined control timing, the recording material S is separated and fed one by one. The recording material S is introduced into the secondary transfer nip N2, with predetermined control timing, as a contact portion between the secondary transfer roller 9 and the transfer belt 5. As a result, in a process in which the recording material P is conveyed through the secondary transfer nip N2, the respective color toner images superposed on the transfer belt 5 are collectively transferred onto the surface of the recording material S.

The recording material S is then separated from the surface of the transfer belt 5 and then is introduced into the fixing unit 10. Then, the recording material S is heated and pressed at a fixing nip. As a result, the toner images are fixed on the recording material S. Thereafter, the recording material S comes out of the fixing device 10 and is discharged, as a full-color image-formed product, onto the upper surface 100*a* of the apparatus main assembly 100A.

[General Structure of Process Cartridge]

In this embodiment, the first to fourth cartridges P (PY, PM, PC, PK) have, as described above, the same electrophotographic process mechanism but are different in color of accommodated toner and in amount of the toner.

Figure 3:
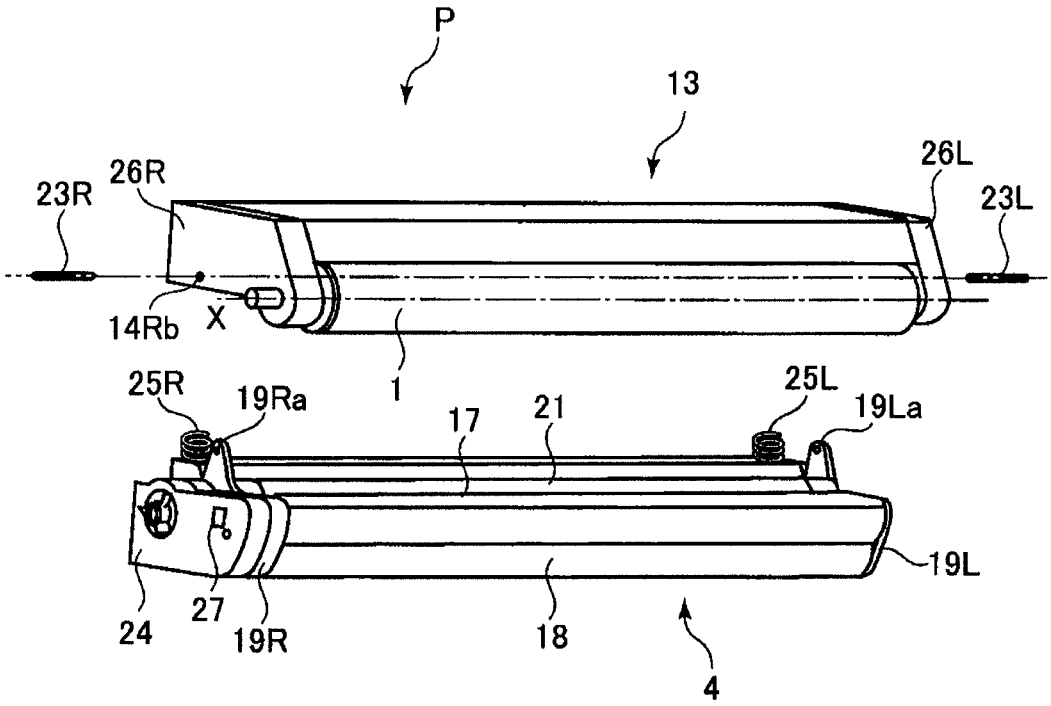
FIG. 3 is an exploded perspective view of the process cartridge in Embodiment 1.

As shown in FIG. 3, each of the cartridges P (PY, PM, PC, PK) is an elongated assembly extending in a direction of a rotational axis X as a longitudinal direction.

Each cartridge P includes the cleaning unit 13 and the developing unit 4.

As shown in FIG. 2, the cleaning unit 13 includes a cleaning (device) frame 14, the photosensitive drum 1, the charging roller 2 and the cleaning blade 6.

Figure 4:
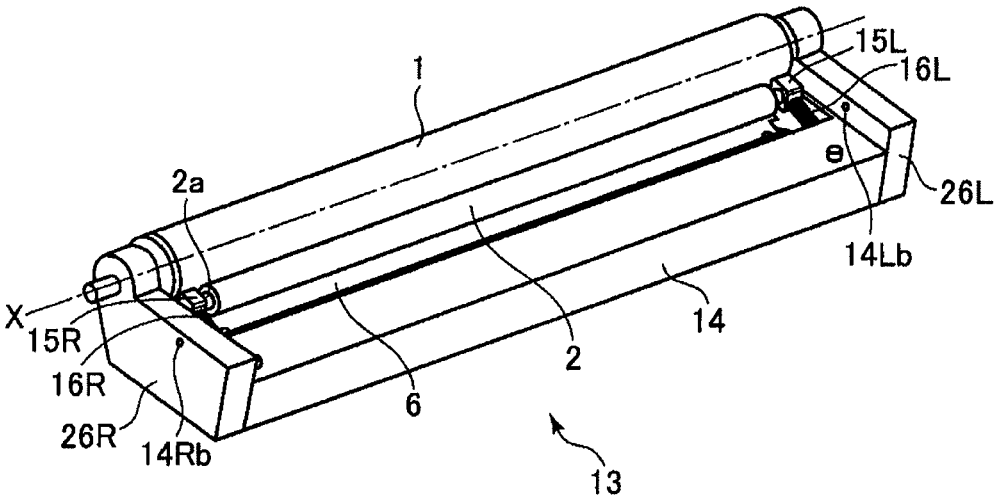
FIG. 4 is a perspective view of a cleaning unit of the process cartridge in Embodiment 1.

The photosensitive drum 1 is, as shown in FIG. 4, rotatably supported by drum bearing members 26 (26R, 26L) mounted to the cleaning frame 14 at longitudinal end portions.

A driving force of a driving motor (not shown) of the apparatus main assembly 100A is transmitted to the photosensitive drum 1, so that the photosensitive drum 1 is rotationally driven in the arrow A direction at the predetermined speed as shown in FIGS. 1 and 2.

The charging roller 2 is a charging member of a contact charging type in which it is rotated by the rotation of the photosensitive drum 1 in contact with the photosensitive drum 1. To the cleaning frame 14, as shown in FIGS. 2 and 4, charging roller supporting members 15 (15R, 15L) are mounted.

Here, the charging roller supporting members 15 (15R, 15L) are, as shown in FIGS. 2 and 4, mounted movably in an arrow C direction along a line passing through the rotation center of the charging roller 2 and the rotation center of the photosensitive drum 1. A rotation shaft 2*a* of the charging roller 2 is rotatably mounted to the charging roller supporting members 15 (15R, 15L).

Further, the charging roller supporting members 15 (15R, 15L) are urged toward the photosensitive drum 1 by urging members 16 (16R, 16L) as an urging means.

As shown in FIG. 2, the cleaning blade 6 is constituted by an elastic rubber blade 6*a* and a supporting metal plate 6*b*. An end 6*c* of the elastic rubber blade 6*a* is disposed in contact with the photosensitive drum 1 with respect to a counter direction to the rotational direction A of the photosensitive drum 1. The cleaning blade 6 performs the function of removing the toner remaining on the photosensitive drum 1. The transfer residual toner removed from the peripheral surface of the photosensitive drum 1 by the cleaning blade 6 is accommodated in a removed toner collecting portion 14*a* in the cleaning frame 14.

Figure 5:
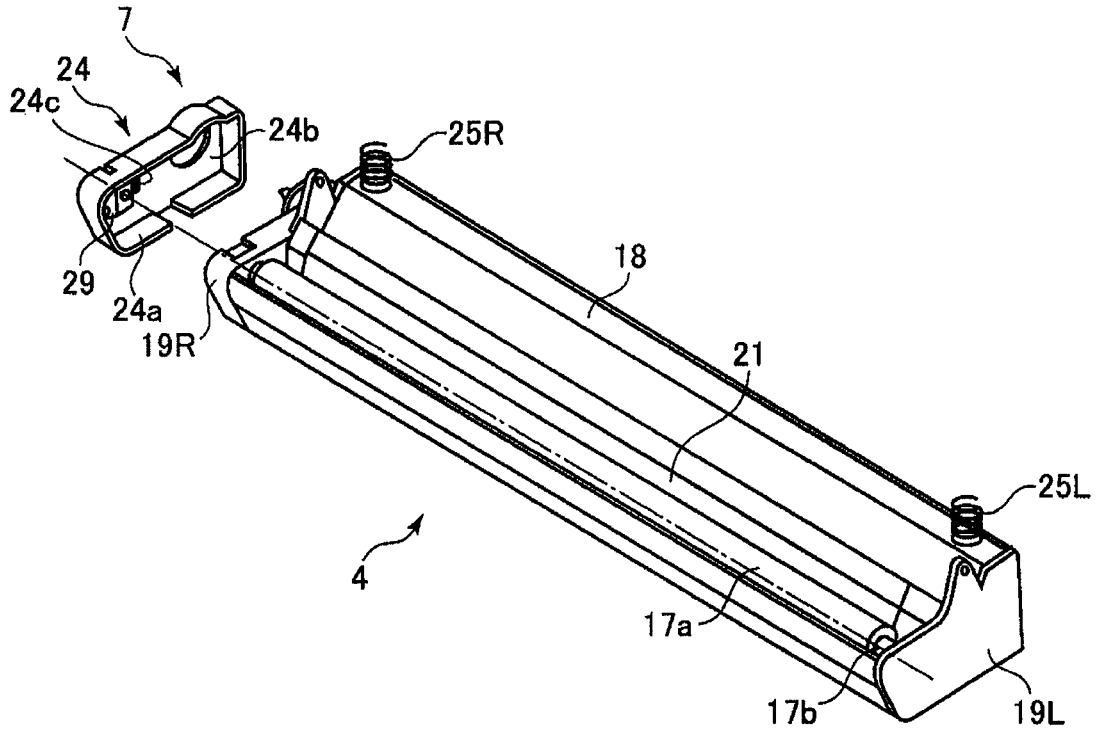
FIG. 5 is a perspective view of a developing unit of the process cartridge in Embodiment 1.

On the other hand, referring to FIGS. 2, 3 and 5, the developing unit 4 includes a developing device frame 18 as a frame for supporting respective elements in the developing unit 4. To the developing unit 4, a developing roller 17 rotating in an arrow D direction (counterclockwise direction) indicated in FIG. 2 in contact with the photosensitive drum 1 is provided. The developing roller 17 is formed by a metal shaft 17*a* and an electroconductive rubber portion 17*b*. In this embodiment, the developing roller 17 and the photosensitive drum 1 are rotated so that their surfaces are moved in the same direction (directed from below to above in this embodiment) at their opposing portion (contact portion).

As shown in FIGS. 3 and 5, the developing roller 17 is rotatably supported by the developing device frame 18 via developing device side plates 19 (19R, 19L) at its end portions with respect to its rotational axis direction. Here, the developing device side plates 19 (19R, 19L) are mounted to the developing device frame 18 at the end portions.

In this embodiment, the developing roller 17 is disposed in contact with the photosensitive drum 1 but may also be disposed close to the photosensitive drum 1 with a predetermined gap.

In the developing unit 4, a developer supplying roller 20 as a developer supplying member rotating in an arrow E direction (counterclockwise direction) indicated in FIG. 2 is disposed. The supplying roller 20 contacts the peripheral surface of the developing roller 17. In this embodiment, the supplying roller 20 and the developing roller 17 are rotated so that their surfaces are moved in opposite directions at their opposing portion (contact portion). The supplying roller 20 performs the function of not only supplying the toner onto the developing roller 17 but also removing the toner, from the surface of the developing roller 17, remaining on the developing roller 17 without being subjected to the development. In the developing unit 4, a developing blade 21 as a developer regulating member for regulating a layer thickness of the toner supplied onto the developing roller 17 by the supplying roller 20 is disposed. The developing blade contacts the peripheral surface of the developing roller 17.

Referring to FIG. 2, in a toner accommodating chamber 18*a* as a developer accommodating chamber formed in the developing device frame 18, a non-magnetic one-component developer as the developer, i.e., the toner T is accommodated. Further, in the toner accommodating chamber 18*a*, a toner feeding member 22 rotatably supported by the developing device frame 18 is provided. The toner feeding member 22 stirs the toner accommodated in the toner accommodated chamber 18*a* and feeds the toner to a developing chamber 18*b* in which the developing roller 17 and the supplying roller 20 are provided.

As shown in FIGS. 3 and 4, connecting shafts 23 (23R, 23L) are engaged in holes 14 (14Rb, 14Lb) provided in the cleaning unit 13 and holes 19*a* (19Ra, 19La) provided in the developing device side plates 19 (19R, 19L). Thus, the developing unit 4 is connected, rotatably about the connecting shaft 23 (23R, 23L), to the cleaning unit 13. During image formation, the developing unit 4 is urged by developing unit urging springs 25 (25R, 25L) as an urging means, thus being rotationally moved about the connecting shafts 23 in an arrow F direction shown in FIG. 2. As a result, the developing roller 17 is contacted to the photosensitive drum 1.

A predetermined bias is applied from a power source (not shown) in the image forming apparatus to the developing roller 17. As a result, the toner conveyed to the developing roller 17 is deposited on the electrostatic latent image at the developing portion at the contact between the developing roller 17 and the photosensitive drum 1, thus developing the electrostatic latent image into the toner image.

[Principal Portion of Process Cartridge]

In the process cartridge P, a means for applying the bias to the developing roller 17 provided in the developing unit 4 and a constitution of the contact (point) will be described specifically.

Referring to FIGS. 3 and 5, in this embodiment, to the developing device side plate 19R which is one of the developing device side plates 19 (19R, 19L), the holding member 24 constituted by an outer peripheral wall 24*a*, having the same shape as the developing device side plate 19R, and a side wall 24*b* provided in one side of the outer peripheral wall 24*a*, is provided. The holding member 24 is prepared by an electrically insulating material and is preferably prepared integrally by plastics. The holding member 24 is mounted to the developing device side plate 19R by contact or partial engagement of an end surface of the outer peripheral wall 24*a* with a side surface of the developing device side plate 19R. In addition, screw, crimp or welding is used in combination, so that the holding member 24 is fixed to the developing device side plate 19R.

Figure 6:
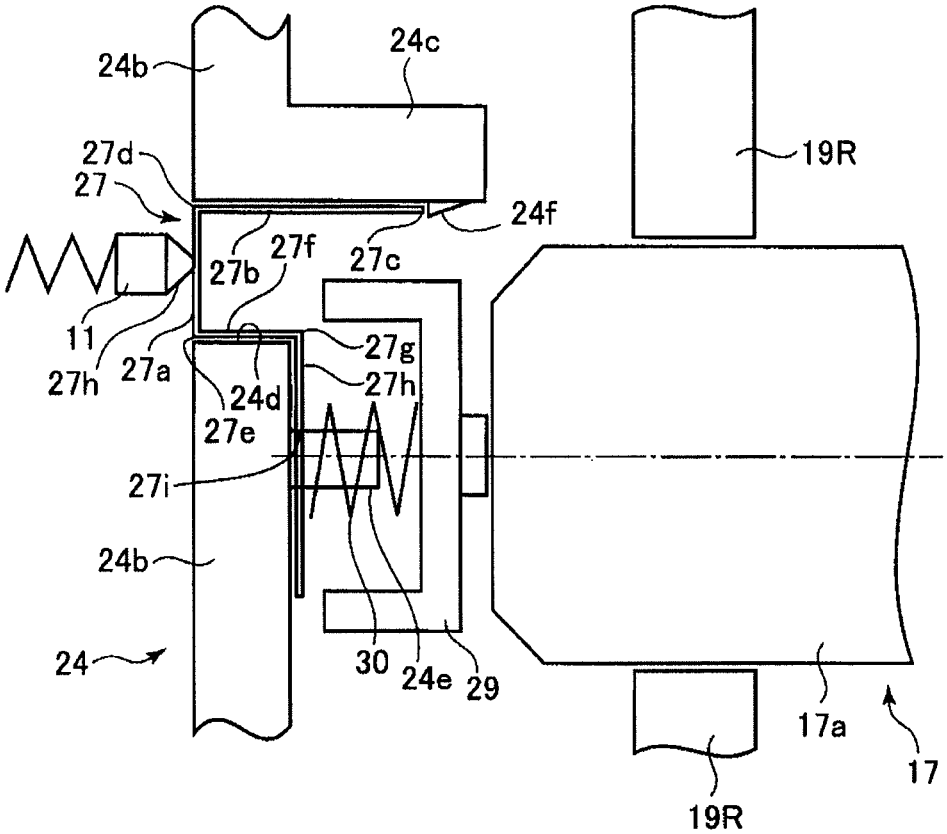
FIG. 6 is a partially sectional view of the process cartridge in Embodiment 1.

FIG. 6 is a sectional view of a cross-section passing through the metal shaft 17*a* as an axis of the developing roller 17 and the contact member 27. As shown in FIG. 6, to the holding member (FIGS. 3 and 5), an energization member (electric energy supplying member) 29, an urging member 30 and the contact member 27 are mounted. In this embodiment, the energization member 29 is formed with an electroconductive resin member, the urging member 30 is formed with a compression spring of a metal wire material, and the contact member 27 is formed with a metal plate of copper alloy. Further, the contact member 27 has a shape which follows a formation surface of the holding member 24. This will be further described later.

The contact member 27 provided to the process cartridge P contacts a main assembly electric contact 11 provided to the apparatus main assembly 100A to receive predetermined pressure, so that the bias is applied. The applied bias is supplied to the developing roller 17 via the urging member 30 and the energization member 29. The urging member 30 urges the developing roller 17 in the rotational axis direction and has the pressure necessary to perform stable bias application to the developing roller 17 which is rotationally driven. The energization member 29 slides on the metal shaft 17*a* of the developing roller 17 by the rotational drive of the developing roller 17 while urging the developing roller 17 by an urging force of the urging member 30.

Here, the contact member 27 is, in order to supply a stable bias to the developing roller 17, required to receive stable contact pressure from the main assembly electric contact 11. For that reason, there is a need to support the contact pressure applied from the main assembly electric contact 11 to the contact member 27.

This will be described with reference to FIGS. 6 and 7. The contact member 27 is located at a position of an opening 24*d* formed in the holding member 24 and has a surface (first surface) 27*a* contacting the main assembly electric contact 11.

The contact member 27 is bent from the first surface 27*a* toward a side opposite from the main assembly electric contact 11, i.e., an opposite side of the contact point, thus forming bent portions 27*d* and 27*e*.

As a result, the contact member 27 has a second surface 27*b* formed by the bending for the bent portion 27*d* and a fourth surface 27*f* formed by the bending for the bent portion 27*e*. Further, the contact member 27 has a third surface 27*h* formed from a bent portion 27*g* formed by bending the contact member 27. That is, the contact member has the third surface 27*h* formed in a side opposite from the second surface 27*b*.

The second surface 27*b* of the contact member 27 is positioned along a holding wall 24*c* formed as a part of the holding member 24 and includes a portion to be limited 27*c* at its end. Further, the fourth surface 27*f* extends toward the inside of the holding member 24, and the third surface 27*h* is positioned along an inner surface of the side wall 24*b* of the holding member 24.

Figure 7:
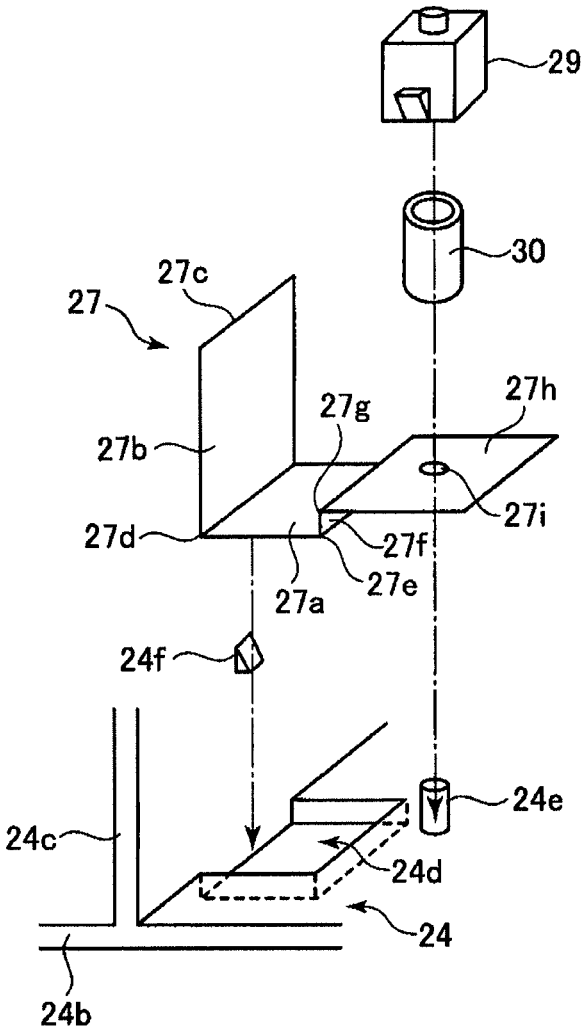
FIG. 7 is an exploded perspective view for illustrating an assembling method of a holding member unit of the process cartridge in Embodiment 1.

The third surface 27*h* of the contact member 27 is provided with a hole 27*i* (FIG. 7). In the hole 27*i*, a projection 24*e* provided and erected on the side wall inner surface of the holding member 24 is to be engaged.

In this case, at a contact portion between the contact member 27 and the urging member 30, the urging force of the urging member 30 and reaction force of the holding member 24 are balanced with each other, so that the contact member 27 is held by the holding member 24. That is, the third surface 27*h* is urged by the urging member 30 and thus the contact member 27 is held by the holding member 24. Further, when the contact pressure by the main assembly electric contact 11 acts on the contact member 27, the portion to be limited 27*c* is contacted to a limiting portion 24*f* provided on the holding wall 24*c*, so that movement of the portion to be limited 27*c* in a contact pressure direction by the main assembly electric contact 11 is limited.

A method of assembling the contact member 27, the urging member 30 and the energization member 29 with the holding member 24 will be described.

As shown in FIG. 7, the projection 24*e* provided to the holding member 24 is engaged in the hole 27*i* while the first surface 27*a* and the second surface 27*b* avoid the limiting portion 24*f*, so that the contact member 27 is positioned to the holding member 24. Then, the urging member 30 is assembled with the projection 24*e* of the holding member 24 and thereon the energization member 29 is assembled. Thus, as shown in FIG. 5, a holding member unit 7 prepared by integrally assembling the contact member 27, the urging member 30, the energization member 29 and the holding member 24 is provided. Further, the holding member unit 7 is assembled with the developing device frame 18, so that the energization member 29 is contacted to the metal shaft 17*a* of the developing roller 17 to complete an electroconductive path.

As described above, even when the contact pressure by the main assembly electric contact 11 acts on the contact member 27, the movement of the contact member 27 is limited by the limiting portion 24*f* provided to the holding member 24. For that reason, even when a limiting member for limiting the movement of the contact member 27 is not disposed in a back side of the contact portion 27*h*, stable contact pressure can be received.

That is, according to the present invention, in the constitution in which the contact member receives the contact pressure from the main assembly electric contact and thus the bias is applied, even in the case where it is difficult to dispose the limiting member, for limiting the movement of the contact member, in the back side of the contact member, it is possible to limit the movement of the contact member. That is, according to the present invention, the movement of the contact member by the contact pressure can be limited by providing the limiting portion to the holding member and therefore even when the limiting member for limiting the movement of the contact member is not disposed, stable contact pressure can be received.

Embodiment 2

Next, another embodiment according to the present invention will be described with reference to FIG. 8. Incidentally, basic constitutions of the developing device, the process cartridge and the image forming apparatus in this embodiment are the same as those in Embodiment 1. Therefore, elements having functions and constitutions identical or corresponding to those in Embodiment 1 are represented by the same reference numerals or symbols and will be omitted from detailed description. In this embodiment, a contact member 27A having a similar constitution as that of the contact member 27 in Embodiment 1 is used. Portions having the same constitutions and functions as those in Embodiment 1 are represented by the same reference numerals or symbols and will be omitted from detailed description.

Figure 8:
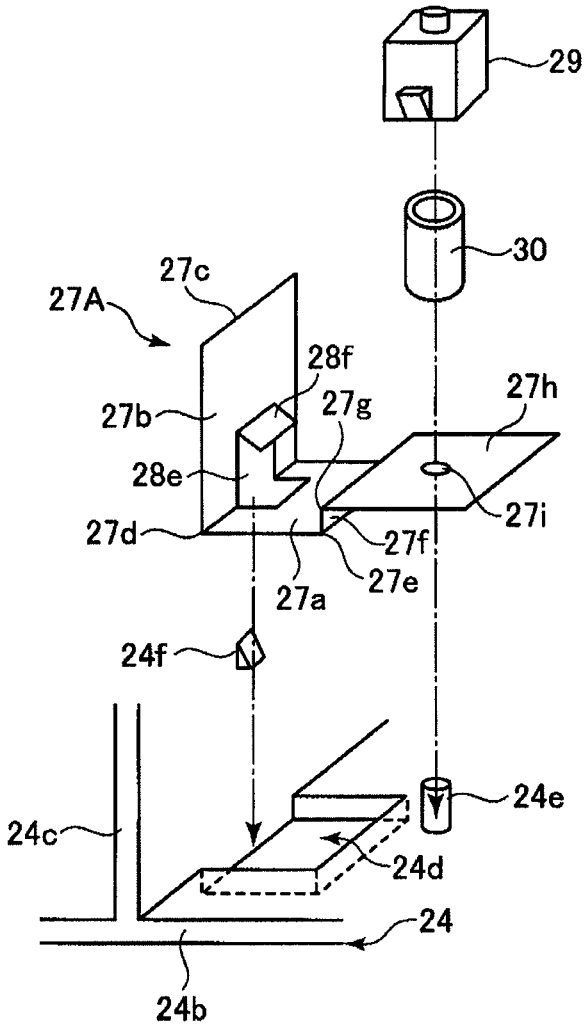
FIG. 8 is an exploded perspective view for illustrating an assembling method of a holding member unit of a process cartridge in Embodiment 2.

Referring to FIG. 8, in this embodiment, the contact member 27A is different from the contact member 27 in Embodiment 1 in that the contact member 27A is provided with a cut-away portion 28*e* and a guide portion (cut and erected portion) 28*f*.

Also in this embodiment, similarly as in Embodiment 1, the contact member 27A is provided with a portion to be limited 27*c*. A method of assembling the contact member 27A, the urging member 30 and the energization member 29 with the holding member 24 will be described.

As shown in FIG. 8, the contact member 27A is assembled with the holding member 24 in a direction indicated by an arrow in the figure. The cut-away portion 28*e* is formed by cutting away a part of the first surface 27*a* and a part of the second surface 27*b* so that the bent portion 27*d* which is a boundary between the first surface 27*a* and the second surface 27*b* is not contacted to the limiting portion 24*f* during the assembling. The guide portion 28*f* is formed by cutting and erecting an end portion of the second surface 27*b* of the cut-away portion 28*e* toward a side (edge) of the portion to be limited 27*c*. At this time, the cut-away portion 28*e* of the contact member 27A passes through the limiting portion 24*f* of the holding member 24 and inclined surfaces of the guide portion 28*f* and the limiting portion 24*f* are assembled while being contacted to each other, so that the portion to be limited 27*c* runs over the limiting portion 24*f*. Further, the projection 24*e* provided to the holding member 24 is engaged in the hole 27*i* provided in the contact member 27, so that the contact member 27 is positioned to the holding member 24. Then, the urging member 30 is assembled with the projection 24*e* of the holding member 24 and thereon the energization member 29 is assembled, so that the energization member 29 is contacted to the metal shaft 17*a* of the developing roller 17 to complete an electroconductive path.

As described above, by providing the contact member 27A with the cut-away portion 28*e* and the guide portion 28*f*, as shown in FIG. 8, the contact member 27A can be easily assembled in one direction (the arrow direction in the figure), so that an assembling property is improved.

Another Embodiment

In Embodiments 1 and 2, the contact constitution of the bias application to the developing roller 11 and the urging constitution in the longitudinal direction are described but as another embodiment, similar constitutions may also be employed for the charging roller 2, the supplying roller 20 and the like. That is, the similar constitutions can also be employed even as a constitution of energization to the process means (the charging roller or the supplying roller) provided in the cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 201208/2011 filed Sep. 14, 2011, which is hereby incorporated by reference herein.

What is claimed is:

1. A cartridge detachably mountable to a main assembly of an image forming apparatus having a main assembly electric contact, the main assembly electric contact being non-detachably attached to the main assembly, said cartridge comprising:

a contact member for receiving pressure by the main assembly electric contact, wherein said contact member has a first surface as a contact portion for receiving the pressure by the main assembly electric contact, a second surface bent from the first surface toward a first side opposite from a second side, the second side being where the main assembly electric contact is provided, and a bent portion which is a boundary between the first surface and the second surface;

a holding member for holding said contact member;

a portion to be limited provided at an end of the second surface; and a limiting portion, provided on said holding member, for limiting movement of said portion to be limited, wherein the first surface is not supported by said holding member from the first side, and wherein a cut-away portion is formed in the bent portion, a part of the first surface, and a part of the second surface, and a cut and erected portion is formed in the second surface by cutting and erecting an end portion of the cut-away portion, at the second surface, toward said portion to be limited.

2. The cartridge according to claim 1, further comprising:

process means for being energized from said contact member, and urging means for urging said process means in a predetermined direction, wherein said contact member has a third surface opposite from the second surface, and wherein the third surface is urged toward said holding member by said urging means.

3. The cartridge according to claim 2, wherein said process means is a developing roller having a shaft, and wherein said urging means urges said developing roller in an axial direction of said developing roller.

4. The cartridge according to claim 1, wherein said contact member has a third surface opposite from the second surface and a fourth surface, opposite from the second surface, bent from the first surface toward a side opposite from the side where the main assembly electric contact is provided, and wherein the third surface is formed by being bent from the fourth surface.

5. The cartridge according to claim 1, further comprising an electrophotographic photosensitive member.

6. An image forming apparatus comprising:

the cartridge according to claim 1; and the main assembly electric contact provided so as to be capable of being pressed against said contact member.

* * * * *